US005715542A

United States Patent [19]

Reinhart, Jr.

[11] Patent Number: 5,715,542

[45] Date of Patent: Feb. 10, 1998

[54] BIB HAVING AN IMPROVED FASTENER

[75] Inventor: Richard Nicholas Reinhart, Jr., Cincinnati, Ohio

[73] Assignee: The Procter & Gamble Company, Cincinnati, Ohio

[21] Appl. No.: 667,155

[22] Filed: Jun. 20, 1996

Related U.S. Application Data

[60] Provisional application No. 60/002,095, Aug. 10, 1995.

[51] Int. Cl.[6] ..... A41B 13/10

[52] U.S. Cl. ..... 2/49.1; 2/52

[58] Field of Search ..... 2/49.1, 49.2, 50, 2/51, 52

[56] References Cited

U.S. PATENT DOCUMENTS

| | | | |
|---|---|---|---|
| 2,164,369 | 7/1939 | Woolever | 2/49 |
| 2,172,162 | 9/1939 | Gillette | 2/49 |
| 2,298,985 | 5/1942 | Kimball | 128/132 |
| 2,424,000 | 5/1947 | Shanker | 2/52 |
| 2,424,680 | 1/1947 | Doyle | 2/49 |
| 2,440,666 | 4/1948 | Miller | 2/52 X |
| 2,468,841 | 5/1949 | Siegel | 2/51 |
| 2,469,835 | 5/1949 | McMartin | 2/49 |
| 2,552,462 | 12/1951 | Savrin | 2/49 |
| 2,704,625 | 3/1955 | Huse | 2/48 X |
| 2,857,599 | 11/1958 | Wallace | 2/49 |
| 3,010,111 | 11/1961 | Ralph | 2/49 |
| 3,147,528 | 9/1964 | Erb | 24/204 |
| 3,266,113 | 8/1966 | Flanagan, Jr. | 24/204 |
| 3,286,279 | 11/1966 | Brown | 2/49 |
| 3,329,969 | 7/1967 | Farber et al. | 2/49 |
| 3,407,407 | 10/1968 | Hollander et al. | 2/49 |
| 3,577,607 | 5/1971 | Ikoma et al. | 24/204 |
| 3,608,092 | 9/1971 | Taranto | 2/49 |
| 3,708,833 | 1/1973 | Ribich | 24/204 |
| 3,871,027 | 3/1975 | Orr | 2/49 R |
| 3,913,183 | 10/1975 | Brumlik | 24/204 |
| 3,916,447 | 11/1975 | Thompson | 2/46 |
| 3,945,048 | 3/1976 | Shearer | 2/49 R |
| 3,979,776 | 9/1976 | Gruenwald | 2/49 R |
| 4,186,443 | 2/1980 | Britzman | 2/49 R |
| 4,216,257 | 8/1980 | Schams et al. | 428/93 |
| 4,233,688 | 11/1980 | Hjerl | 2/49 R |
| 4,261,057 | 4/1981 | Anderson | 2/49 R |
| 4,307,493 | 12/1981 | Ochial | 24/204 |
| 4,330,907 | 5/1982 | Ochial | 24/204 |
| 4,416,025 | 11/1983 | Moret et al. | 2/49 R |
| 4,441,212 | 4/1984 | Ahr et al. | 2/49 R |
| 4,445,231 | 5/1984 | Noel | 2/49 R |
| 4,454,183 | 6/1984 | Wollman | 428/92 |
| 4,495,658 | 1/1985 | Moret et al. | 2/49 R |
| 4,523,333 | 6/1985 | Spangler | 2/49 R |
| 4,523,334 | 6/1985 | Lavash | 2/49 R |
| 4,553,550 | 11/1985 | Hattori | 128/505 |
| 4,622,698 | 11/1986 | Heyman et al. | 2/49 R |
| 4,649,572 | 3/1987 | Roessler | 2/49 R |
| 4,660,226 | 4/1987 | Quilling et al. | 2/49 R |
| 4,733,411 | 3/1988 | Foti | 2/49 R |

(List continued on next page.)

FOREIGN PATENT DOCUMENTS

| | | | |
|---|---|---|---|
| 600109 | 6/1960 | Canada | 2/48 |
| 0 171 053 A2 | 2/1986 | European Pat. Off. . | |
| 2 671 270 A1 | 7/1992 | France . | |
| WO 94/23610 | 10/1994 | WIPO . | |

OTHER PUBLICATIONS

Essentials of Textiles, Third Edition, p. 237, "NETS", Author: Marjory L. Joseph.

*Primary Examiner*—C. D. Crowder
*Assistant Examiner*—Shirra L. Jenkins
*Attorney, Agent, or Firm*—Gerry S. Gressel; Larry L. Huston; E. Kelly Linman

[57] ABSTRACT

A disposable bib having an improved mechanical fastener assembly is disclosed. The mechanical fastener assembly includes an extended target surface and an array of prongs elements extending from a surface of the bib. The mechanical prong elements provide secure fastening of the bib shoulder extensions, yet are soft to the touch.

24 Claims, 3 Drawing Sheets

U.S. PATENT DOCUMENTS

| | | | |
|---|---|---|---|
| 4,769,024 | 9/1988 | Pike et al. | 604/390 |
| 4,779,288 | 10/1988 | Mack | 2/49 R |
| 4,793,004 | 12/1988 | Long et al. | 2/49 R |
| 4,797,952 | 1/1989 | Petrini | 2/49 R |
| 4,811,428 | 3/1989 | Waldman et al. | 2/49 R |
| 4,846,815 | 7/1989 | Scripps | 604/391 |
| 4,846,822 | 7/1989 | Foxman | 604/370 |
| 4,884,299 | 12/1989 | Rose | 2/49 R |
| 4,891,846 | 1/1990 | Sager et al. | 2/49 R |
| 4,894,060 | 1/1990 | Nestegard | 604/391 |
| 4,946,527 | 8/1990 | Battrell | 156/60 |
| 4,951,318 | 8/1990 | Harreld et al. | 2/49 R |
| 4,963,140 | 10/1990 | Robertson et al. | 604/389 |
| 5,019,065 | 5/1991 | Scripps | 604/385.1 |
| 5,032,122 | 7/1991 | Noel et al. | 604/391 |
| 5,058,247 | 10/1991 | Thomas et al. | 24/448 |
| 5,074,013 | 12/1991 | Arnold et al. | 24/713 |
| 5,077,870 | 1/1992 | Melbye et al. | 24/452 |
| 5,100,710 | 3/1992 | Rizzuto | 2/49.1 X |
| 5,116,563 | 5/1992 | Thomas et al. | 264/167 |
| 5,180,534 | 1/1993 | Thomas et al. | 264/145 |
| 5,218,721 | 6/1993 | Mathews et al. | 2/49 R |
| 5,221,276 | 6/1993 | Battrell | 604/389 |
| 5,300,058 | 4/1994 | Goulait et al. | 604/391 |
| 5,318,741 | 6/1994 | Thomas et al. | 264/519 |
| 5,325,569 | 7/1994 | Goulait et al. | 24/448 |
| 5,326,415 | 7/1994 | Thomas et al. | 156/244.11 |
| 5,392,498 | 2/1995 | Goulait et al. | 24/452 |
| 5,493,734 | 2/1996 | Nieves-Rivera | 2/209.13 |
| 5,530,968 | 7/1996 | Crockett | 2/46 |

BIB HAVING AN IMPROVED FASTENER

This application claims priority to U.S. Provisional application Ser. No. 60/002,095, filed on Aug. 10, 1995.

FIELD OF THE INVENTION

The present invention is related to disposable bibs, and more particularly, to a bib having an improved fastener for securing the bib to the wearer.

BACKGROUND OF THE INVENTION

Disposable bibs are well known in the art. Such bibs can be provided for use on babies during feeding. Disposable bibs can have a laminate construction comprising multiple layers. For instance, disposable bibs can include an absorbent paper topsheet for receiving spilled food material and a plastic film backsheet for preventing penetration of spilled liquids through the bib and onto the baby's clothing. Other multiple layer bib constructions are also known.

The prior art also discloses bibs having different mechanisms for securing a bib to the wearer's person. For instance, a bib can include straps which are tied together behind the wearer's neck to secure the bib to the wearer. It is also known to use snaps, tape type fasteners, and Velcro type fasteners to secure a bib to a wearer.

The following documents disclose various bibs, including bibs having fastening mechanisms: U.S. Pat. No. 3,286,279 issued Nov. 22, 1966; U.S. Pat. No. 3,871,027 issued Mar. 18, 1975; U.S. Pat. No. 3,916,447 issued Nov. 4, 1975; U.S. Pat. No. 3,979,776 issued Sep. 14, 1976 U.S. Pat. No. 4,416,025 issued Nov. 22, 1983; U.S. Pat. No. 4,441,212 issued Apr. 10, 1984; U.S. Pat. No. 4,445,231 issued May 1, 1984; U.S. Pat. No. 4,495,658 issued Jan. 29, 1985; U.S. Pat. No. 4,523,333 issued Jun. 18, 1985; U.S. Pat. No. 4,523,334 issued Jun. 18, 1985; and patent U.S. Pat. No. 5,074,013 issued Dec. 24, 1991.

The following documents disclose various mechanical fastening devices: U.S. Pat. No. 4,216,257 issued Aug. 5, 1980; U.S. Pat. No. 4,846,815 issued Jul. 11, 1989; U.S. Pat. No. 4,894,060 issued Jan. 16, 1990; U.S. Pat. No. 5,392,498 issued Feb. 28, 1995; U.S. Pat. No. 5,326,612 issued Jul. 5, 1994; and U.S. Pat. No. 5,407,439 issued Apr. 18, 1995; and PCT Publication WO 94/23610 published Oct. 27, 1994.

Straps can be inconvenient to handle and tie. A problem associated with adhesive and mechanical fasteners is that the fasteners can be uncomfortable and abrasive if they contact the wearer's skin. In addition, a problem associated with securing a bib to a wearer is that, in fastening the bib to the wearer to accommodate the wearer's neck size, the portion of the bib covering the wearer's chest can become distorted, thereby causing the bib to gap away from the wearer's chest. Such distortion can cause discomfort, and also leave a portion of the wearer unprotected from food spills.

Accordingly, it is one object of the present to provide a disposable bib which can be conveniently secured to a wearer.

Another object of the present invention is to provide a disposable bib having a fastener which is non-irritating to the wearer's skin.

Another object of the present invention is to provide a disposable bib which can accommodate a wide range of neck sizes.

SUMMARY OF THE INVENTION

The present invention comprises a disposable bib having a longitudinal centerline, a lateral width, and longitudinally extending side edges. The disposable bib comprises a bib body, first and second shoulder extensions extending from the bib body to provide a neck opening having a longitudinal length, and a mechanical fastener associated with the shoulder extensions for releasably joining together the shoulder extensions in an overlapping fashion.

Each shoulder extension has a front surface and a back surface, and each shoulder extension has a proximal end and a distal end, wherein the proximal and distal ends of the first shoulder extension are disposed to one side of the longitudinal centerline and wherein the proximal and distal ends of the second shoulder extension are disposed to the other side of the longitudinal centerline.

The mechanical fastener comprises a target surface disposed on a surface of at least one of the shoulder extensions, and an array of target engaging elements extending from the opposite surface of the other shoulder extension. The target surface has a length which is at least 0.25 times, and in one embodiment, at least about 0.5 times the longitudinal length of the neck opening.

The array of target engaging elements can comprise a nondirectional array of prongs. The target surface can comprise a nonwoven web joined to the front surface of each of the shoulder extensions. The nondirectional array of prongs and the nonwoven web provide a fastening system which is relatively soft and non-irritating to the wearer. The nondirectional array of target engaging elements, coupled with the extended length of the target surface, permit the shoulder extensions to be secured together at different degrees of overlapping, so that the bib can be secured to wearer's having a wide range of neck sizes.

BRIEF DESCRIPTION OF THE DRAWINGS

While the specification concludes with claims particularly pointing out and distinctly claiming the present invention, the invention will be better understood from the following description taken in conjunction with the accompanying drawings in which like designations are used to designate substantially identical elements, and in which:

DETAILED DESCRIPTION OF THE INVENTION

Figure 1:
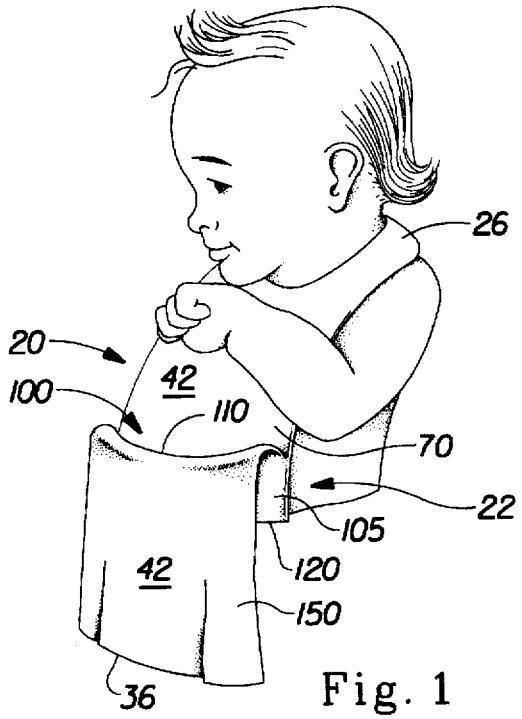
FIG. 1 is an in use perspective view of a disposable bib according to the present invention.
Figure 2:
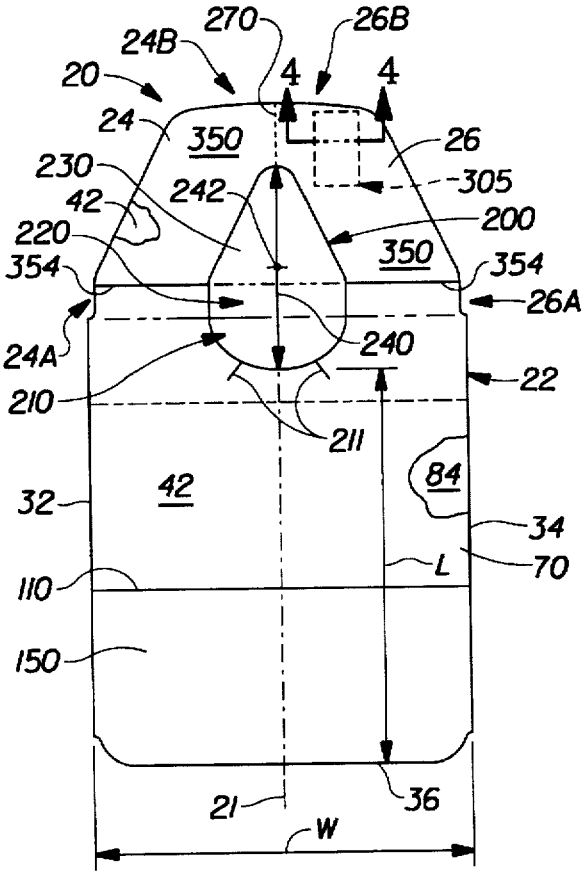
FIG. 2 a front plan view of the disposable bib of the present invention wherein the bib is supported in a flat, generally planar orientation.
Figure 3:
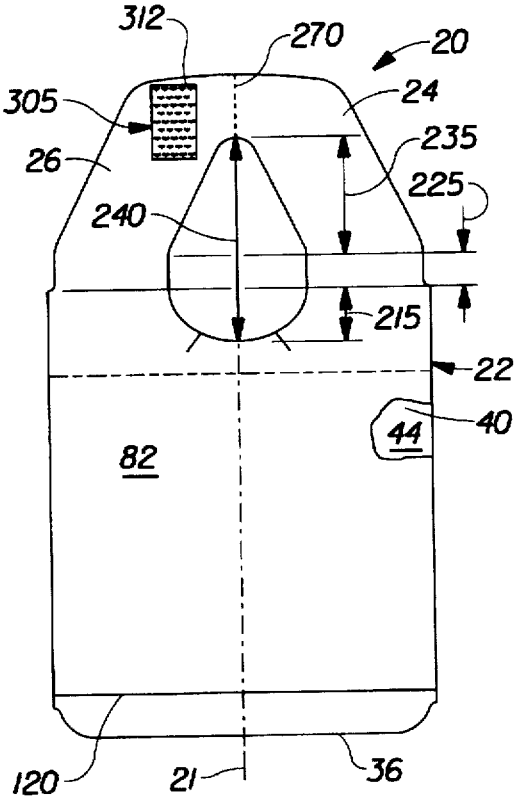
FIG. 3 is a rear plan view of a disposable bib of the present invention.

FIGS. 1–3 illustrate a disposable bib 20 according to one embodiment of the present invention. The bib 20 comprises a bib body 22 having longitudinally extending sides 32 and 34, a longitudinal length L, a longitudinal centerline 21, a laterally extending bottom edge 36, and a lateral width W. The term "longitudinal" refers to a direction or axis measured along the length of the bib body 22, which direction or axis is generally parallel to a line extending from the wearer's head to the wearer's waist, as the bib is worn. The terms "lateral" and "transverse" refer to a direction or axis which is perpendicular to the longitudinal centerline 21, and which is generally parallel to a line extending across the wearer's chest as the bib is worn.

The bib 20 also comprises a pair of shoulder extensions 24, 26 having proximal ends 24A, 26A and distal ends 24B, 26B. The shoulder extensions 24, 26 extend from the bib body 22 from their proximal ends to their distal ends to provide a generally planar neck opening 200 when the bib is supported on a flat, horizontal surface. Each shoulder extensions has a front surface which faces outward when the bib is worn, and a back surface which faces the wearer when the bib is worn. When the bib is supported in a generally flat configuration on a flat, horizontal surface, the proximal end 24A and the distal end 24B are disposed to one side of the longitudinal centerline 21, and the proximal end 26A and distal end 26B are disposed to the other side of the longitudinal centerline 21.

The generally planar neck opening 200 can have a front neck portion 210, a rear neck portion 230, and a maximum width portion 220 disposed intermediate the front neck portion 210 and the rear neck portion 230. The neck opening 200 can also have a longitudinal length 240 measured along the longitudinal centerline 21. (FIG. 2).

The generally planar neck opening 200 can be generally symmetric about a longitudinal axis, such as the longitudinal centerline 21, and can be generally asymmetric about a lateral axis passing through the midpoint 242 of the longitudinal length 240 when the bib is supported on a flat, horizontal surface. The lateral asymmetry of the neck opening 200 promotes fit about different neck sizes and shapes without slipping, while reducing the tendency of the bib body 22 to gap away from the wearer's chest when the shoulder extensions 24, 26 are overlapped behind the wearer's neck to fasten the bib to the wearer.

The bib 20 can also include a pocket 100 extending substantially the full lateral width of the bib 20 for catching and receiving food particles. In one embodiment, the bib body 22 can comprise a body panel 70, a pocket panel 105, and an apron panel 150. The body panel 70 can be separated from the pocket panel 105 by a laterally extending fold in the bib body, and the pocket panel 105 can be separated from the apron panel 150 by another parallel laterally extending fold in the bib body.

The body panel 70 is disposed adjacent the wearer's body when the bib is secured to the wearer. The pocket panel 105 can have a generally rectangular shape, and is disposed adjacent the body panel 70 to form a pocket space intermediate the body panel and the pocket panel. The pocket panel 105 extends longitudinally from a pocket bottom edge 120 to a pocket open edge 110, and the pocket panel 105 extends laterally intermediate the bib side edges 32 and 34. The bottom edge 120 and the open edge 110 can both be substantially perpendicular to the longitudinal centerline 21 and substantially parallel to an imaginary lateral axis.

The apron panel 150 can extend from the pocket open edge 110 to the bib bottom edge 36. The apron panel 150 can depend in a pendulous fashion from the pocket open edge 110 to provide gravitational opening of the pocket 100. The body panel 70, pocket panel 105, and apron panel 150 can be formed from a continuous sheet of material, the sheet of material comprising one or more laminae. U.S. Pat. No. 4,445,231 "Bib Having Gravitationally Openable Pocket" issued May 1, 1984 to Noel is incorporated herein by reference for the purpose of showing a bib construction for forming a bib having a pocket and an apron panel.

The bib 20 also comprises a mechanical fastener assembly associated with the shoulder extensions for releasably joining together shoulder extensions in an overlapping configuration. The mechanical fastener comprises a target surface 350 disposed on a front surface of one of the shoulder extensions, and an array 305 of target engaging elements, such as an array of projections 310, extending from the opposite surface of the other shoulder extension. The target surface 350 has a length 351 (FIG. 5) which is at least 0.25 times, and in one embodiment, at least about 0.5 times, the longitudinal length 240 of the neck opening 200.

Figure 4:
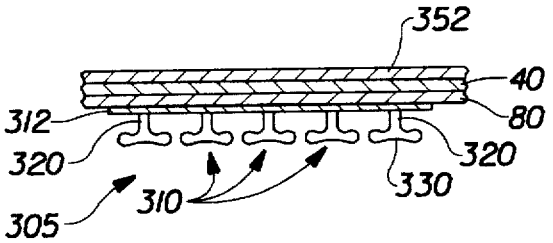
FIG. 4 is a cross-sectional view taken along lines 4—4 in FIG. 2

In one embodiment, the fastener can comprise an array 305 of projections extending from a substrate 312 joined to the shoulder extension 26. The target surface 350 can comprise the surface 350 of a nonwoven web 352 disposed on at least a portion of the shoulder extension 24 (FIGS. 2–4). In the embodiments shown, the web 352 is disposed on both the shoulder extensions 24, 26 to provide a soft, nonabrasive surface about the wearer's neck. The array 305 of projections is preferably non-directional, so that the shoulder extensions 24, 26 can be secured together in any convenient angular orientation, to thereby accommodate a wide range of neck sizes and fit preferences, and take advantage of the extended target surface 350. An array 305 of projections can be placed on each of the shoulder extensions to allow fastening by overlapping either of the shoulder extensions on top of the other (i.e. shoulder extension 24 over 26, or alternatively, shoulder extension 26 over 24).

Referring to the components of the bib 20 in more detail, the bib 20 according to the present invention can comprise a composite construction having multiple laminae. For instance, the bib 20, including the bib body 22 and the shoulder extensions 24, 26, can comprise a laminate of an absorbent outer topsheet layer 40 and a garment facing backsheet layer 80 which is liquid impermeable relative to the topsheet 40. The topsheet 40 has a first outer surface 42 for receiving spilled food material, and a second inner surface 44. The backsheet 80 has a first garment facing surface 82 and a second surface 84. The surface 84 of the backsheet 80 and the surface 44 of the topsheet 40 are oppositely facing surfaces, and can be joined together, such as with an adhesive, to form a laminate. In one embodiment, the shoulder extensions 24, 26, the bib body panel 70, the pocket panel 105, and the apron panel 150 are formed from a single, continuous sheet of the laminate of the topsheet 40 and the backsheet 80.

The topsheet 40 can comprise a paper web having a basis weight of from about 10 to about 50 pounds per three thousand square feet. The following U.S. Patents are incorporated by reference for the purpose of disclosing how to make tissue paper suitable for use in making a topsheet 40: U.S. Pat. Nos. 4,191,609; 4,440,597; 4,529,480; 4,637,859; 5,223,096; and 5,240,562. A suitable topsheet 40 can be formed from a single ply or multiple ply paper towel, such as a BOUNTY Paper Towel manufactured by The Procter and Gamble Company of Cincinnati, Ohio.

The backsheet 80 can comprise a liquid impervious polymeric film, such as a polyolefinic film. In on embodiment the backsheet 80 can comprise a polyethylene film having a thickness of between about 0.0076 millimeter and about 0.0508 millimeter. In one embodiment the backsheet can comprise a FS-II embossed polyethylene film having a thickness of about 1 mil and manufactured under the designation CPC-2 (P-9703) by Tredegar Film Products of Cincinnati, Ohio.

The topsheet 40 can be joined to the backsheet 80 in any suitable manner, including but not limited to methods such as adhesive bonding, mechanical bonding, and ultrasonic bonding. A suitable adhesive for joining the topsheet 40 and the backsheet 80 is a hot melt adhesive such as a hot melt pressure sensitive adhesive. One particular adhesive which is suitable for joining the topsheet 40 to the backsheet 80 is an HL-1258 adhesive manufactured by H. B. Fuller Co. of St. Paul, Minn. Other suitable adhesives include Findley Adhesives H2031 and H2120 available from Findley Adhesives of Elmgrove, Wis.

The mechanical fastener can comprise an array 305 of polyolefinic prongs 310 extending from a polyolefinic substrate 312. In one embodiment, the prongs 310 comprise a prong shank 320 extending from a prong base proximal the substrate 312 to a prong end 330 having a width greater than the width of the prong shank. The array 305 can comprise between about 600 and about 3600 prongs 310 per square inch, each having a prong end 330 having an edge which extends radially outward from the prong shank around the entire circumference of the prong shank, the prong end 330 having a generally rounded edge. The prong end 330 can also comprise a rounded surface opposite the prong shank. In one embodiment, the prong end 330 can have a generally concave shape opposite the prong shank, as shown in FIG. 4. Such an array of prongs 310 provides a relatively soft, non-abrasive surface to reduce irritation of the wearer's skin. Such an array of prongs is also non-directional, because the ability of the array of prongs to engage the target surface 350 is not affected by the angular orientation of the array 315 of prongs 310 with respect to target surface 350. In contrast, an array 305 of hook shaped target engagement elements can be directionally oriented.

Figure 8A:
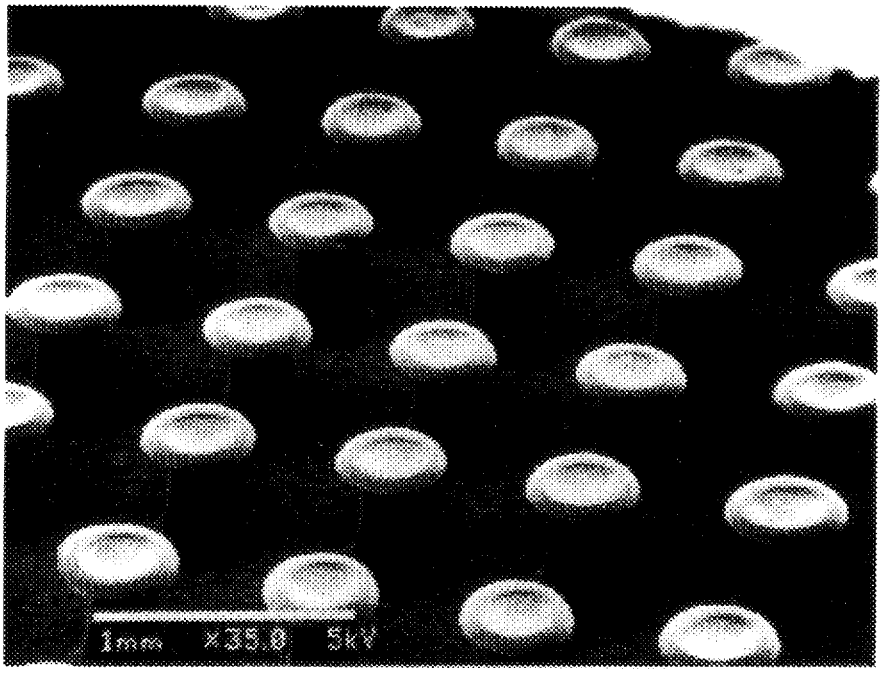
FIG. 8A is a photomicrograph of an array of prongs used in a fastener assembly.

In one embodiment, the array 305 can include about 900 prongs 310 per square inch. A suitable fastener comprising a substrate 312 having pressure sensitive adhesive disposed on a first surface of the substrate and an array 305 of prongs 310 extending from a second, opposite surface of the substrate is manufactured by the 3M Company of St. Paul, Minn. under the designation XPH-4152. FIG. 8A illustrates such an array.

Figure 8B:
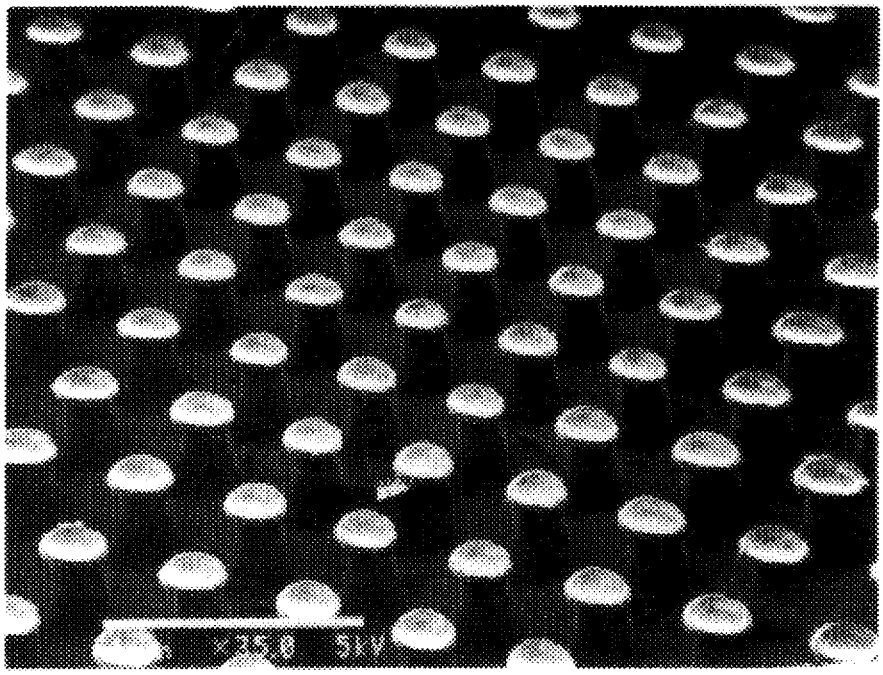
FIG. 8B is a photomicrograph of another array of prongs.

In another embodiment, the array 305 of prongs 310 can comprise about 2500 prongs per square inch, and can comprise a fastener manufactured by the 3M Co. under the designation XPH-4182. FIG. 8B illustrates such an array.

In an alternative embodiment, the array 305 can comprise hook shaped elements. A suitable fastener comprising hook shaped elements is manufactured by the 3M Company under the designation KN0513.

The following documents are incorporated by reference for the purpose of disclosing suitable arrays of target engaging elements, including directional and non-directional arrays, and including hook shaped and non-hook shaped target engaging elements: U.S. Pat. No. 4,216,257 issued Aug. 5, 1980; U.S. Pat. No. 4,846,815 issued Jul. 11, 1989; U.S. Pat. No. 4,894,060 issued Jan. 16, 1990; U.S. Pat. No. 5,392,498 issued Feb. 28, 1995; U.S. Pat. No. 5,326,612 issued Jul. 5, 1994; and U.S. Pat. No. 5,407,439 issued Apr. 18, 1995; and PCT Publication WO 94/23610 published Oct. 27, 1994.

The target surface 350 can comprise the surface of a nonwoven web of fibers 352 disposed on at least a portion of the shoulder extensions 24 and 26 to cover an upper portion of the surface 42 of topsheet 40. In the embodiment shown in FIG. 2, the target surface 350 extends over the majority of the outer surface of the shoulder extensions 24 and 26, and terminates at a lower edge 354. The edge 354 is located adjacent to the juncture of the rear neck opening portion 230 with the maximum width neck portion 220. The extended target surface 350 thus cooperates with the non-directional array 305 of projections to enable secure yet comfortable fastening over a wide range of neck sizes and fit preferences.

Accordingly, the nonwoven web also extends over portions of the shoulder extensions which can come in contact with the wearer's skin, such as portions of the shoulder extensions 24 and 26 which are bounded by the rear neck opening portion 230, and presents a soft, non-irritating surface to the wearer's skin. In alternative embodiment, the nonwoven web can extend below the neck perimeter to cover all or a portion of the body panel 70. The nonwoven web 352 can have the characteristic that it permits liquids to pass through to the absorbent topsheet layer 40, while the surface 350 remains relatively dry to the wearer's touch. In addition, the nonwoven web 352 can contribute to the absorbency of the bib by creating void space intermediate the nonwoven web 352 and the topsheet 40.

The nonwoven web 352 is selected so that the prongs 310 can securely engage the fibers of the web 352. In one embodiment, the target surface 350 can comprise the surface of a web 352 of spunlaid, thermally point bonded polypropylene fibers, the web having a basis weight of about 22 grams per square meter and the fibers having an average denier less than about 3.0 grams per 9000 meter of fiber length. A suitable nonwoven web 352 is manufactured by the Fiberweb Corp. of Simpsonville, S.C. under the designation Celestra Unicorn. Such a web of fibers provides a target surface which can be securely engaged by the above listed prongs 310, and which is soft and nonabrasive to the wearer's skin.

Figure 5:
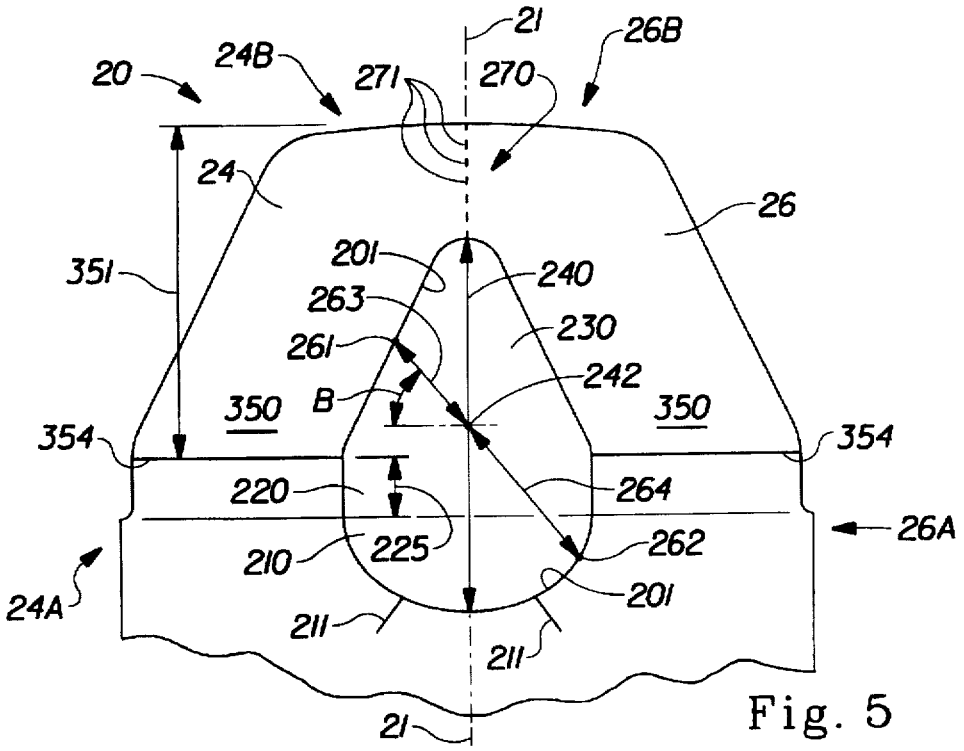
FIG. 5 is an enlarged, partial schematic illustration of a neck opening having a closed shape, the figure illustrating measurement of the lateral asymmetry ratio and angle B when the bib is supported in a flat, generally planar orientation.
Figure 6:
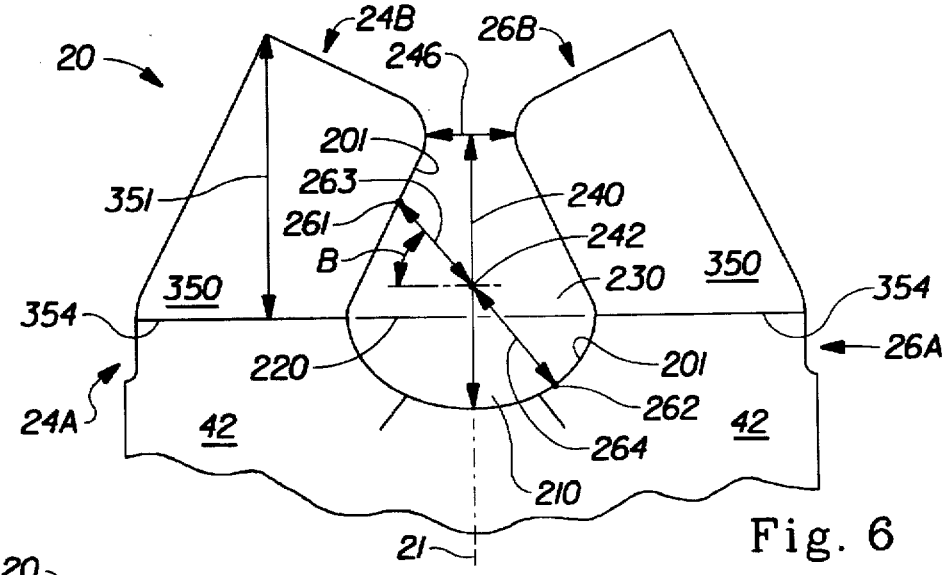
FIG. 6 is an enlarged, partial schematic illustration of a neck opening having an open and rearwardly converging shape.
Figure 7:
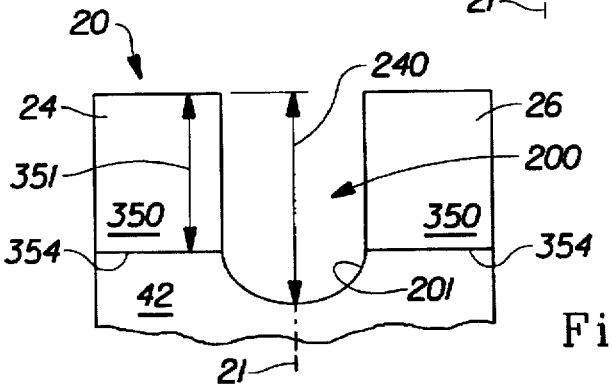
FIG. 7 is an enlarged partial schematic illustration of an open U-shaped neck opening which is not rearwardly converging.

The generally planar neck opening 200 can have a closed shape, as shown in FIG. 5, or an open shape as shown in FIGS. 6 and 7. In FIGS. 5 and 6, the maximum lateral width of the opening 200 is located in the maximum width portion 220 disposed intermediate the front and rear neck portions. The maximum lateral width located in the maximum width portion 220 is greater than lateral widths measured in the front and rear neck opening portions. The U shaped opening shown in FIG. 7 does not include a maximum width portion disposed intermediate a front neck opening portion and a rear neck opening portion.

The maximum width portion 220 of the opening 200 can have a finite longitudinal length 225, as shown in FIG. 5 (e.g. the portion 220 has a generally rectangular shape), or alternatively, the maximum width portion 220 can be a line of maximum width, as shown in FIG. 6. The longitudinal length 225 of the maximum width portion 220 can be less than the longitudinal length 215 of the front neck opening portion 210, as measured along the longitudinal centerline 21.

If the neck opening 200 has a closed shape, as shown in FIG. 5, the length to 240 is measured along the longitudinal centerline 21 between opposite points on the perimeter 201 of the opening 200. If the neck opening comprises a V-shape or a U-shape, the longitudinal length 240 is measured along the longitudinal centerline as shown in FIG. 7.

If the neck opening 200 has an open shape comprising a front neck opening portion, a rear neck opening potion, and a maximum width neck opening portion disposed between the front and rear neck opening portions, as shown in FIG. 6, the minimum lateral width 246 separating the edges of the shoulder extensions 24 and 26 in the rear neck opening portion is first identified. The longitudinal length 240 is then measured along the longitudinal centerline 21 from the front neck opening portion 210 to the midpoint of the lateral width 246. If there are multiple locations in the rear neck portion 230 having the minimum lateral width 246, the length 240 is measured from the front neck opening to the midpoint of the minimum lateral width 246 positioned closest to the front neck opening portion 210.

The target surface 350 has a surface area which is substantially larger than that of the array 305 of prongs 310. In the embodiments shown, the target surface 350 covers at least about 50 percent of the front surface area of each of the shoulder extensions 24 and 26. The target surface area 350 has a length 351 (FIGS. 5, 6, and 7) which is at least 0.25 times, and in one embodiment, at least about 0.5 times, the longitudinal length 240 of the neck opening 200. The length 351 is measured parallel to the longitudinal centerline 21, as shown in FIGS. 5–7, between the two most distant longitudinally aligned points on the surface 350. While the target surface 350 is shown as being continuous along the length 351, it will be understood that the target surface 350 could be discontinuous intermediate longitudinally aligned portions of the surface 350. For instance, the target surface 350 could comprise a plurality of horizontally extending, vertically spaced apart segments, or a plurality of discrete segments in the shape of circles or squares.

In the embodiment shown in FIG. 5, the front neck opening portion 210 can have a perimeter 201 can comprise a shape which is generally concave with respect to the center of the neck opening (i.e. concave upward as the bib is worn) as shown in FIG. 5. The perimeter 201 of the front neck portion 210 can comprise any number of commonly recognized geometric shapes, including but not limited to oval, circular, parabolic, or elliptical shapes. Alternative, the perimeter of the front neck portion 210 could comprise one or more straight line segments, or a combination of straight line segments and curved segments.

A plurality of slits 211 can extend in a generally radial fashion from the perimeter 201 of the front neck opening portion 210. The slits 211 provide a close yet comfortable fit of the perimeter 210 of front neck opening portion 210 against the wearer's neck. The slits 211 allow the resulting petal like portions of bib intermediate the slits 211 to slide over each other as the shoulder extensions 24, 26 are overlapped. The slits 211 thereby help reduce distortion and gapping of the bib body as the neck opening 200 is made to conform to the wearer's neck. Accordingly, the slits 211 cooperate with the shape of the neck opening 200 and the elongated target surface 350 to improve fit of the bib about the wearer's neck, and reduce distortion and gapping of the bib body as the shoulder extensions 24, 26 are overlapped to accommodate a particular neck size. Such slits, or bifurcations, are disclosed generally in U.S. Pat. No. 4,416,025 to Moret, which Patent is incorporated herein by reference.

The rear neck opening portion 230 can have a perimeter 201 comprising straight line segments, or a combination of straight line segments and curved segments. In FIGS. 5 and 6, the perimeter of the rear neck portion 230 comprises generally straight line segments defined by the inside edges of the shoulder extensions 24 and 26. These straight line segments are convergent, but do not necessarily intersect, as the rear neck opening portion 230 extends from the maximum width portion 220, such that the rear neck opening portion 230 is tapered as it extends from the maximum width portion 220. The concave perimeter of the front neck opening portion 210 and the tapered rear neck opening portion 230 provide a teardrop shaped neck opening 200, as shown in FIG. 5. FIG. 6 shows a teardrop shaped neck opening 200 which is truncated.

The rear neck opening portion 230 can have a longitudinal length 235 which is greater than the longitudinal length 215 of the front neck opening portion 210, as shown in FIGS. 3. In one embodiment, the longitudinal length 235 is at least about 1.2 times, in another embodiment, at least about 1.5 times, and in still another embodiment, at least about 2.0 times the longitudinal length 215. For instance, in one nonlimiting embodiment, the length 215 can be about 1.2 inches, the length 225 can be about 0.64 inch, the length 235 can be about 2.7 inch, and the lateral width of the maximum width portion 220 can be about 3.4 inch.

Varying neck sizes and shapes having a lateral width less than that of the maximum width portion 220 can be accommodated by overlapping the shoulder extensions 24 and 26 to different degrees. Overlapping the shoulder extensions 24 and 26 to releasably fasten the shoulder extensions behind the wearer's neck will generally cause at least some distortion of the bib body 22, which can cause the bib body 22 to gap away from the wearer's chest. This distortion will generally increase as the shoulder extensions are overlapped to a greater degree.

In the embodiments shown in FIG. 5 and 6, the bib of the present invention provides a neck opening 200 and target surface 350 which combine to securely yet comfortably fit a wide range of neck sizes and shapes while minimizing the above mentioned distortion and gapping. Bibs with shoulder extensions defining a circular neck opening when the bib is in a generally planar orientation will generally exhibit high distortion when the shoulder extensions are overlapped to fit necks significantly smaller than the diameter of the circular opening. Bibs having a neck opening with a laterally elongated oval shape (major axis oriented laterally) will also exhibit significant distortion as the shoulder extensions are overlapped to accommodate smaller neck sizes.

Bibs with shoulder extensions defining a longitudinally elongated oval shaped neck opening (major axis oriented longitudinally) when the bib is in a generally planar orientation can exhibit less distortion than bibs having laterally elongated openings. However, such a neck opening shape may act as a slot, allowing the bib to shift longitudinally relative to the wearer. Bibs having shoulder extensions defining a U or V-shaped neck opening when the bib is in a generally planar orientation can shift longitudinally, and also exhibit excessive distortion when the shoulder extensions are overlapped.

The bibs shown in FIGS. 5 and 6 have the advantage that the shoulder extensions 24 and 26 engage the rear portion of the wearer's neck at varying degrees of overlap to accommodate a wide arrange of neck sizes, while reducing the amount of distortion of the bib body 22 which would otherwise occur as the overlap is increased to accommodate relatively smaller neck sizes.

The generally planar neck opening 200 according to the present invention can have a lateral asymmetry milo greater than 1.0. In some embodiments, the ratio can be at least about 1.15, in other embodiments at least about 1.25, and in yet other embodiments at least about 1.5. A bib opening 200 having longitudinal symmetry and a lateral asymmetry ratio greater than 1.0 provides the advantage that the perimeter 201 of the rear neck opening portion can engage the back portion of necks of various size with minimal distortion and gapping of the bib body 22. Referring to FIGS. 5 and 6, the lateral asymmetry ratio is measured using the following procedure.

The bib 20 is supported on a flat, horizontal surface to provide a generally planar neck opening 200. A "generally planar neck opening 200" is provided when the shoulder extensions 24,26 and the body panel 70 are in substantially the same plane and the shoulder extensions 24, 26 are in a non-overlapping configuration. The midpoint 242 of the length 240 is then located, such as with a ruler having its edge placed over the bib and along the centerline 21. The location of the midpoint can be marked on the flat, horizontal surface. An imaginary line is then constructed which extends through the midpoint 242 of the longitudinal length 240 of the neck opening and which intersects the perimeter 201 of the neck opening 200 at two points: a first intersection point 261 located on the perimeter of the rear neck portion 230 and a second intersection point 262 in an opposite portion of the perimeter of the neck opening (points 261, 262, and 242 are collinear). The location of point 261 is chosen so that the ratio of the distance 264 (measured from the midpoint 242 to the second point 262) to the distance 263 (measured from the midpoint 242 to the first point 261) is maximum. This ratio, obtained by dividing distance 264 by distance 263, is the asymmetry ratio of the neck opening 200.

In one embodiment the generally planar neck opening 200 has a lateral asymmetry ratio within a particular angular portion of the neck opening 200, as defined by an angle B. It is desirable that the generally planar neck opening 200 have a lateral asymmetry ratio exceeding 1.0 within a particular angular portion of the neck opening so that the neck opening can securely engage the back portion of the wearer's neck with a component of force which prevents slipping or shifting of the bib relative to the wearer.

Referring to FIGS. 5 and 6, angle B is measured from a lateral axis passing through midpoint 242. In one embodiment, the neck opening 200 has an asymmetry ratio of at least about 1.1, in another embodiment at least about 1.25, and in another embodiment at least about 1.5, wherein the asymmetry ratio is positioned within an angular portion of the neck opening defined by: 15 degrees <B<80 degrees, and more particularly, within an angular portion defined by 25 degrees <B<75 degrees.

Prior to the time the bib is to be used, the shoulder extensions 24 and 26 can be joined together, such as at their distal ends 24B, 26B, along a selective line of weakening 270. When the bib is to be used, the shoulder extensions are separable along the selective line of weakening 270, such that the shoulder extensions can be separated without tearing or otherwise damaging other portions of the bib, and releasably joined together in an overlapping fashion by the fastening assembly.

In one embodiment, the selective line of weakening 270 is aligned with the longitudinal centerline 21, and comprises a plurality of spaced apart perforations 271. The perforations 271 extend partially or fully through the thickness of the bib 200. The perforations can be formed with a perforating knife, and can extend through each of the backsheet 80, topsheet 40, and nonwoven web 352.

The selective line of weakening 270 provides the advantage that the distal ends of the shoulder extensions are interconnected, rather than loose, prior to use. The bib is therefore easier to handle prior to use. In addition, the use of a selective line of weakening provides for ease of manufacturing. For instance, the bibs 20 can be manufactured by joining together continuous webs of the backsheet 80 material, the topsheet 40 material, and the nonwoven 352 material to form a continuous, multiple laminae sheet. The multiple laminae sheet can then be perforated at predetermined positions corresponding to the desired location of each bib to be cut from the sheet.

While particular embodiments of the present invention have been illustrated and described, it would be obvious to those skilled in the art that various other changes and modifications can be made without departing from the spirit and scope of the invention. It is intended to cover in the appended claims all such changes and modifications that are within the scope of the invention.

What is claimed:

1. A disposable bib having a longitudinal centerline, a lateral width, and longitudinally extending side edges, the disposable bib comprising:

a bib body comprising a paper layer;

first and second shoulder extensions extending from the bib body to provide a neck opening having a longitudinal length, each shoulder extension having a front surface and a back surface, and each shoulder extension having a proximal end and a distal end, wherein the proximal and distal ends of the first shoulder extension are disposed to one side of the longitudinal centerline and wherein the proximal and distal ends of the second shoulder extension are disposed to the other side of the longitudinal centerline; and a mechanical fastener associated with the shoulder extensions for releasably joining together shoulder extensions in an overlapping configuration, wherein the mechanical fastener comprises:

a target surface separate from the paper layer and disposed on a surface of one of the shoulder extensions, and an array of target engaging elements extending from the opposite surface of the other shoulder extension;

and wherein the target surface has a length which is at least 0.25 times the longitudinal length of the neck opening.

2. The bib of claim 1 wherein the target surface has a length which is at least about 0.5 times the longitudinal length of the neck opening.

3. The bib of claim 2 wherein the array of target engaging elements is nondirectional.

4. The bib of claim 1 wherein the shoulder extensions extend from the bib body to provide a generally planar neck opening; wherein the generally planar neck opening has front neck portion, a rear neck portion, and a maximum width portion disposed intermediate the front neck portion and the rear neck portion, and wherein the generally planar neck opening is generally symmetric about a longitudinal axis and generally asymmetric about a lateral axis passing through the midpoint of the longitudinal length of the neck opening.

5. The bib of claim 1 wherein the army of elements comprises an array of hook shaped elements.

6. The bib of claim 1 wherein the array of elements comprises an array of prongs having a prong base joined to a surface of a shoulder extension, a prong end for engaging the target surface, and a prong shank extending from the prong base to the prong end, and wherein the prong end is enlarged relative to the prong shank.

7. The bib of claim 6 wherein the prong end has an edge which extends outward from the prong shank around the entire circumference of the prong shank.

8. The bib of claim 6 wherein the array of prongs is non-directional.

9. The bib of claim 8 wherein the array of prongs comprises at least about 600 elements per square inch.

10. The bib of claim 9 wherein the target surface is disposed on a front surface of one of the shoulder extensions to cover at least 50 percent of the surface area of the shoulder extension, and wherein the array of target surface engaging elements is disposed on the back surface of the other shoulder extension.

11. The bib of claim 10 wherein the target surface comprises a nonwoven web of fibers.

12. The bib of claim 11 wherein a nonwoven web of fibers is disposed on the front surface of each of the shoulder extensions.

13. The bib of claim 1 wherein the bib body comprises a plurality of slits extending from the neck opening.

14. A disposable bib having a longitudinal centerline, a lateral width, and longitudinally extending side edges, the disposable bib comprising:

a bib body comprising a paper web layer and a liquid impervious film layer;

first and second shoulder extensions comprising the paper web layer and the liquid impervious film layer, the shoulder extensions extending from the bib body to provide a neck opening having a longitudinal length, each shoulder extension having a front surface and a back surface, and each shoulder extension having a proximal end and a distal end, wherein the proximal and distal ends of the first shoulder extension are disposed to one side of the longitudinal centerline and wherein the proximal and distal ends of the second shoulder extension are disposed to the other side of the longitudinal centerline; and a mechanical fastener associated with the shoulder extensions for releasably joining together shoulder extensions in an overlapping configuration, wherein the mechanical fastener comprises:

a target surface separate from the paper web layer, the target surface comprising a nonwoven web of fibers disposed on the front surface of one of the shoulder extensions, and an array of non-directional target engaging elements extending from the opposite surface of the other shoulder extension;

and wherein the target surface has a length which is at least 0.25 times the longitudinal length of the neck opening.

15. The bib of claim 1 wherein the shoulder extensions extend from the bib body to provide a generally planar neck opening; wherein the generally planar neck opening has front neck portion, a rear neck portion, and a maximum width portion disposed intermediate the front neck portion and the rear neck portion, and wherein the generally planar neck opening is generally symmetric about a longitudinal axis and generally asymmetric about a lateral axis passing through the midpoint of the longitudinal length of the neck opening.

16. The bib of claim 14 wherein the bib body comprises a plurality of slits extending from the neck opening.

17. The bib of claim 14 wherein a nonwoven web of fibers is disposed on the front surface of each of the shoulder extensions.

18. The bib of claim 17 wherein the array of elements comprises an array of prongs having a prong base joined to a surface of a shoulder extension, a prong end for engaging the target surface, and a prong shank extending from the prong base to the prong end, and wherein the prong end is enlarged relative to the prong shank.

19. The bib of claim 18 wherein the prong end has an edge which extends outward from the prong shank around the entire circumference of the prong shank.

20. The bib of claim 18 wherein the array of prongs comprises at least about 600 elements per square inch.

21. A disposable bib, the disposable bib comprising:

a bib body comprising a paper layer and a liquid impervious film layer;

first and second shoulder extensions comprising the paper web layer and the film layer, the first and second shoulder extensions extending from the bib body to provide a generally planar neck opening having a longitudinal length; wherein the generally planar neck opening has a front neck portion, a rear neck portion, and a maximum width portion disposed intermediate the front neck portion and the rear neck portion, each shoulder extension having a front surface and a back surface;

a nonwoven web associated with the front surface of each of the shoulder extensions, the nonwoven web covering at least a portion of the paper layer and having a length which is at least 0.5 times the longitudinal length of the neck opening; and an array of elements, the elements extending from the back surface of at least one of the shoulder extensions, the array of elements engageable with the nonwoven web for releasably joining together the shoulder extensions in an overlapping configuration.

22. The disposable bib of claim 21 wherein the nonwoven web covers the portion of the shoulder extensions which define the rear neck portion of the neck opening.

23. The disposable bib of claim 21 wherein at least a portion of the paper web layer is not covered by the nonwoven web.

24. The disposable bib of claim 23 wherein bib comprises a plurality of slits extending from the neck opening, and wherein the slits extend through a portion of the paper web layer which is not covered by the nonwoven web.

* * * * *

UNITED STATES PATENT AND TRADEMARK OFFICE

CERTIFICATE OF CORRECTION

PATENT NO. : 5,715,542

DATED : February 10, 1998

INVENTOR(S) : RICHARD NICHOLAS REINHART, JR.

It is certified that error appears in the above-identified patent and that said Letters Patent is hereby corrected as shown below:

Column 5, line 36, "315" should read -- 305 --.

Column 6, line 63, "to 240" should read -- 240 --.

Column 7, line 2, "potion," should read -- portion, --.

Column 8, line 64, "milo" should read -- ratio --.

Column 10, line 60, "army" should read -- array --.

Signed and Sealed this

First Day of June, 1999

*Attest:*

Q. TODD DICKINSON

*Attesting Officer*

*Acting Commissioner of Patents and Trademarks*